US007749095B2

(12) United States Patent
Nishitani

(10) Patent No.: US 7,749,095 B2
(45) Date of Patent: Jul. 6, 2010

(54) GOLF CLUB HEAD

(75) Inventor: Masafumi Nishitani, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 299 days.

(21) Appl. No.: 12/040,136

(22) Filed: Feb. 29, 2008

(65) Prior Publication Data

US 2008/0214321 A1 Sep. 4, 2008

Related U.S. Application Data

(63) Continuation of application No. 10/954,235, filed on Oct. 1, 2004, now abandoned.

(30) Foreign Application Priority Data

Oct. 3, 2003 (JP) ..... 2003-345929
Nov. 4, 2003 (JP) ..... 2003-374622

(51) Int. Cl.
*A63B 53/02* (2006.01)

(52) U.S. Cl. ..... 473/305; 473/345; 473/349

(58) Field of Classification Search ..... 473/291, 473/292, 304, 305, 309, 311, 334, 335, 345, 473/346, 349
See application file for complete search history.

(56) References Cited

U.S. PATENT DOCUMENTS 4,417,731 A 11/1983 Yamada
5,205,552 A * 4/1993 Green, Jr. ..... 473/312
5,362,055 A 11/1994 Rennie
D366,508 S 1/1996 Hutin
5,485,998 A 1/1996 Kobayashi
5,556,097 A 9/1996 Endo et al.
5,645,495 A 7/1997 Saso
5,722,901 A * 3/1998 Barron et al. ..... 473/305
D394,290 S 5/1998 Best et al.
5,823,887 A 10/1998 Mikame et al.
D401,637 S 11/1998 Best et al.
5,851,160 A 12/1998 Rugge et al.
D406,295 S 3/1999 Long
D408,880 S 4/1999 Crow
5,916,043 A 6/1999 Saso
6,206,789 B1 3/2001 Takeda
6,254,494 B1 7/2001 Hasebe et al.
6,364,788 B1 4/2002 Helmstetter et al.
6,368,230 B1 4/2002 Helmstetter et al.
6,371,868 B1 4/2002 Galloway et al.

(Continued)

FOREIGN PATENT DOCUMENTS

JP 59-102063 U 7/1984

(Continued)

OTHER PUBLICATIONS

Japanese Office Action Dated Sep. 16, 2008.

*Primary Examiner*—William M Pierce
(74) *Attorney, Agent, or Firm*—Sughrue Mion, PLLC

(57) ABSTRACT

A weight material is provided on a heel side of a hosel portion in a golf club head. A convex portion E is provided on the heel side of the head. The weight material is disposed within the convex portion. The weight material is made of high specific gravity metal such as tungsten, and welded on both a lower column and a skirt portion.

2 Claims, 10 Drawing Sheets

U.S. PATENT DOCUMENTS

| | | | | |
|---|---|---|---|---|
| 6,478,691 | B2 * | 11/2002 | Okoshi | 473/324 |
| 6,620,055 | B2 | 9/2003 | Saso | |
| 6,855,067 | B2 * | 2/2005 | Solheim et al. | 473/310 |
| 6,884,179 | B2 * | 4/2005 | Hoffman et al. | 473/312 |
| 6,926,616 | B1 | 8/2005 | Kusumoto et al. | |
| 6,997,818 | B2 * | 2/2006 | Kouno | 473/305 |
| 7,063,628 | B2 * | 6/2006 | Reyes et al. | 473/324 |
| 7,241,229 | B2 * | 7/2007 | Poyno | 473/309 |
| 2001/0007835 | A1 * | 7/2001 | Baron | 473/305 |
| 2002/0019266 | A1 | 2/2002 | Yabu | |
| 2002/0065142 | A1 * | 5/2002 | Okoshi | 473/324 |
| 2002/0082117 | A1 | 6/2002 | Nishitani et al. | |
| 2002/0137575 | A1 | 9/2002 | Tseng | |
| 2004/0152536 | A1 * | 8/2004 | Solheim et al. | 473/305 |
| 2005/0215350 | A1 * | 9/2005 | Reyes et al. | 473/344 |
| 2006/0058116 | A1 | 3/2006 | Yabu | |
| 2008/0096688 | A1 * | 4/2008 | Yokota | 473/345 |

FOREIGN PATENT DOCUMENTS

| | | | |
|---|---|---|---|
| JP | 62-197365 | U | 12/1987 |
| JP | 6-335540 | A | 12/1994 |
| JP | 7-67991 | A | 3/1995 |
| JP | 07-185049 | A | 7/1995 |
| JP | 10-151232 | A | 6/1998 |
| JP | 10-225540 | A | 8/1998 |
| JP | 11-047318 | A | 2/1999 |
| JP | 2000-126339 | A | 5/2000 |
| JP | 2000-140164 | A | 5/2000 |
| JP | 2001-137393 | A | 5/2001 |
| JP | 2001-190719 | A | 7/2001 |
| JP | 2001-212272 | A | 8/2001 |
| JP | 2002-113135 | A | 4/2002 |
| JP | 2002-210047 | A | 7/2002 |
| JP | 2003-169866 | A | 6/2003 |
| JP | 2004-261451 | A | 9/2004 |

* cited by examiner

GOLF CLUB HEAD

CROSS-REFERENCE TO RELATED APPLICATION

This is a continuation of application Ser. No. 10/954,235 filed Oct. 1, 2004, which claims priority under 35 USC 119 from Japanese Patent Application Nos. 2003-345929 and 2003-374622. The entire disclosures of the prior applications are incorporated by reference herein.

BACKGROUND OF THE INVENTION

1. Field of the Invention

The present invention relates to a hollow golf club head, and more particularly to a golf club head (hereinafter simply referred to as a head) of wood type or similar shape.

2. Description of the Related Art

As the wood type golf club head such as a driver or a fairway wood, hollow and metallic heads are commonly employed. Generally, a hollow golf club head 1 of wood type includes a face portion 2 for hitting a ball, a crown portion 3 configuring an upper face portion of the golf club head, a sole portion 4 configuring a bottom face portion of the golf club head, a side portion 5 configuring a side face portion on a toe side, a back side and a heel side of the golf club head and a hosel portion 6, as shown in FIG. 4. A shaft 7 is inserted into the hosel portion 6 of the golf club head and fixed by adhesives. Recently, many golf club heads called a utility club have appeared on a market. As one kind of this utility golf club head, various golf club heads similar to the wood type golf club head (i.e., having the face portion, sole portion, side portion, crown portion and hosel portion) are commercially available on the market.

This hollow golf club head is made of aluminum alloy, stainless or titanium alloy. In late years, titanium alloy is particularly employed.

Recently, the hollow golf club head partially made of fiber reinforced plastic is commercially available on the market.

In late years, the driver heads are increased in size, and those of 350 cc-over category and or 400 cc-over category have appeared on the market.

In this way, if the heads are increased in size, the distance between center of gravity of the head and the hosel portion is larger, and moment of inertia of the head is larger. Since such head with the large moment of inertia is less likely turned at a swing, the player, especially at a beginner's level, is easy to slice.

In FIG. 9 of JP-A-7-67991, a wood type golf club head having a high specific gravity material attached on an outer surface of a hosel portion on a heel side is shown.

SUMMARY OF THE INVENTION

The above golf club head described in JP-A-7-67991 has a high specific gravity material protruding from an outer face of a hosel portion to a heel side (player side), which makes an appearance worse. Also, when the golf club is put into or taken out of a caddie bag, the high specific gravity material is likely to be caught on the caddie bag or other clubs. There is a fear that the high specific gravity material of the hosel portion becomes tangled with grasses so as to cause a miss shot when hitting a ball on a rough.

It is an object of the present invention to solve the above-mentioned problem, and provide a golf club head that has small moment of inertia and an excellent appearance, can be put into or taken out of the caddie bag smoothly, and can make a shot smoothly on the rough.

The invention provides a golf club head including a hollow main body; a hosel portion that penetrates through at least one of an upper face of the main body on a heel side and an upper side of a side face of the main body on the heel side, and is integrated with the main body; and a weight member that is provided on the hosel portion at a heel side thereof.

The hosel portion may include a skirt portion and a column extending downwards from the skirt portion, and the weight member may be disposed between the skirt portion and the column.

The skirt portion may include a convex portion protruding outwards, and the weight member is fixed to an inner surface of the convex portion.

The hosel portion may include a first member on the heel side and a second member on a toe side, and the first member may be higher in specific gravity than the second member.

The invention provides a golf club head including a hollow main body; and a hosel portion that penetrates through at least one of an upper face of the main body on a heel side and an upper side of a side face of the main body on the heel side, and is integrated with the main body, wherein at least a part of the side face of the main body on the heel side includes a weight member.

In the case, a part of the side face of the main body on the heel side may include a convex portion protruding outwards, and at least a part of the convex portion may include the weight member.

The main body and the hosel portion may be made of metal.

The main body may be a metallic cast product, the weight member may be made of metal, and the weight member may be cast into the main body.

At least a part of the side face of the main body on the heel side may be made of fiber reinforced plastic.

The part of the side face on the heel side made of fiber reinforced plastic may include a first layer and a second layer, and the weight member may be disposed between the first layer and the second layer.

In the case, the weight member is made of fiber reinforced plastic containing metal powder. The weight member may include metal piece.

In the golf club heads of the invention, the weight member is provided on the heel side of the hosel portion, whereby the head has smaller moment of inertia. Also, since this weight member is disposed within the head main body, the head is superior in appearance. In the case where the weight member is not protruded from the golf club head, the golf club head can be put into or taken out of the caddie bag smoothly. Moreover, when making a shot on a rough, the head on the heel side does not become tangled with grasses on the rough.

In the case where the weight member is fixed on both the hosel portion and the heel side of the golf club head main body, vibration of the weight member at a time of shot is prevented or suppressed, and a feeling of hitting becomes better.

A part of the hosel portion is configured to be a convex portion protruding outwards. In the case where the weight member is fixed on the convex portion, the center of gravity of the head takes place further on the heel side, whereby the moment of inertia is further reduced. This convex portion has preferably a convex curved shape smoothly swollen (i.e., curved face).

In the case where at least a part of the hosel portion of the golf club head main body is made of a high specific gravity material on the heel side, and a low specific gravity material on the toe side, the main body parts of the golf club head are commonly used with those of the golf club head of other type, and hosel parts are only configured in the above manner, whereby a manufacturing cost of the golf club head is lowered.

In the golf club heads of the invention, the weight member is provided on the heel side of the golf club head main body, whereby the head has smaller moment of inertia. Also, since this weight member configures the side face of the head main body, the head is superior in appearance. In the case where the weight member is not protruded from the golf club head, the golf club head can be put into or taken out of the caddie bag smoothly. Moreover, when making a shot on the rough, the head on the heel side does not become tangled with grasses on the rough.

In the case where a part of the hosel portion is configured to be a convex portion protruding outwards, and at least a part of the convex portion is made of a weight member, the center of gravity of the head takes place further on the heel side, whereby the moment of inertia is further reduced. This convex portion has preferably a convex curved shape smoothly swollen (i.e., curved face).

In the case where the golf club head main body is a metallic cast product, the weight member is a high specific gravity metal, and the weight member is cast into the golf club head main body, the weight member is firmly integrated with the golf club head main body. Thereby, the vibration of the weight member at the time of shot is prevented or suppressed, and the feeling of hitting is better.

In the case where at least a part of the side face of the golf club head main body on the heel side is made of fiber reinforced plastic having the weight member, it is possible to use a greater amount of the weight member without increasing the weight of the golf club head, because fiber reinforced plastic is light. Therefore, the golf club head is easily designed in terms of the center of gravity.

In this case, the part of the side face on the heel side is made of fiber reinforced plastic on the outer face and the inner face of the golf club head main body, with the weight member interposed between the outer face and the inner face, whereby the weight member is firmly integrated with fiber reinforced plastic.

In the case where the weight member is made of fiber reinforced plastic containing metal powder, the weight member and the fiber reinforced plastic are integrated very firmly.

In the case where the weight member is made of a metal piece, the metal piece is made thinner, whereby the weight of the golf club head on the heel side is increased without making the thickness on the heel side excessive.

This invention is suitably applicable to the large golf club head having a volume of 250 cc, especially 300 cc, or more specifically over 350 cc. An example of this golf club head is a driver. This invention is also applicable to the golf club head of fairway wood or the utility golf club head similar to the wood type.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1A:
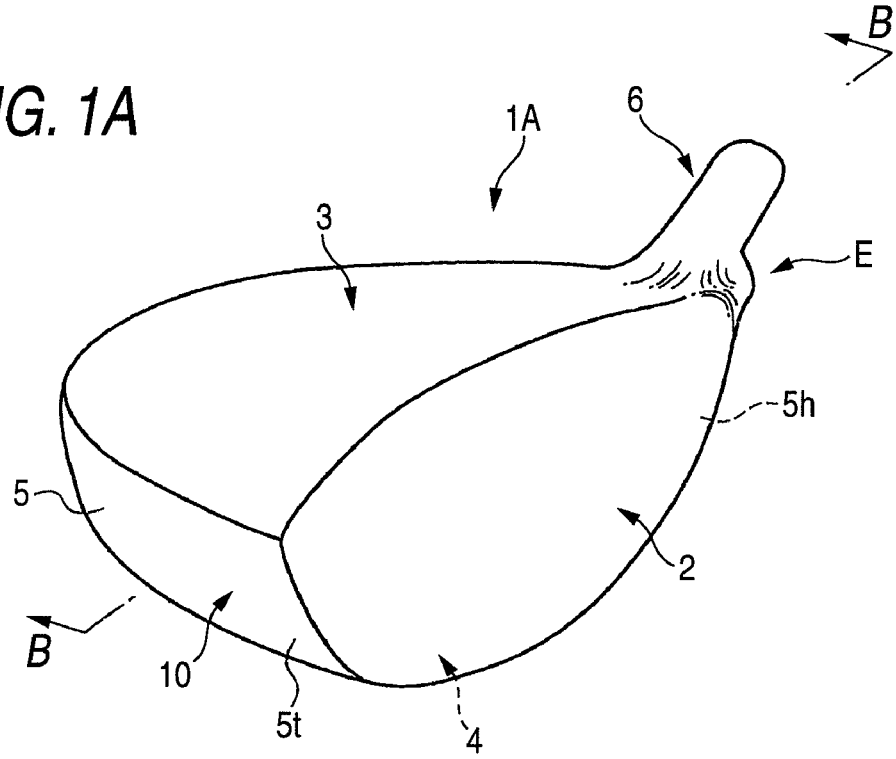
FIG. 1A is a perspective view of a golf club head according to a first embodiment of the invention.
Figure 1B:
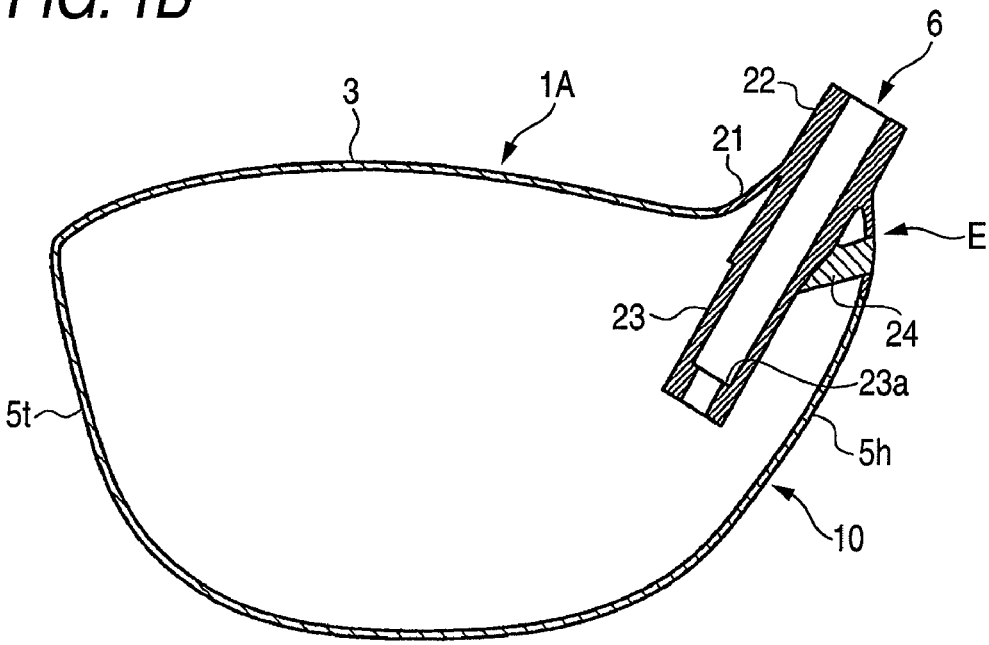
FIG. 1B is a cross-sectional view of the golf club head taken along the line B-B in FIG. 1A.
Figure 2:
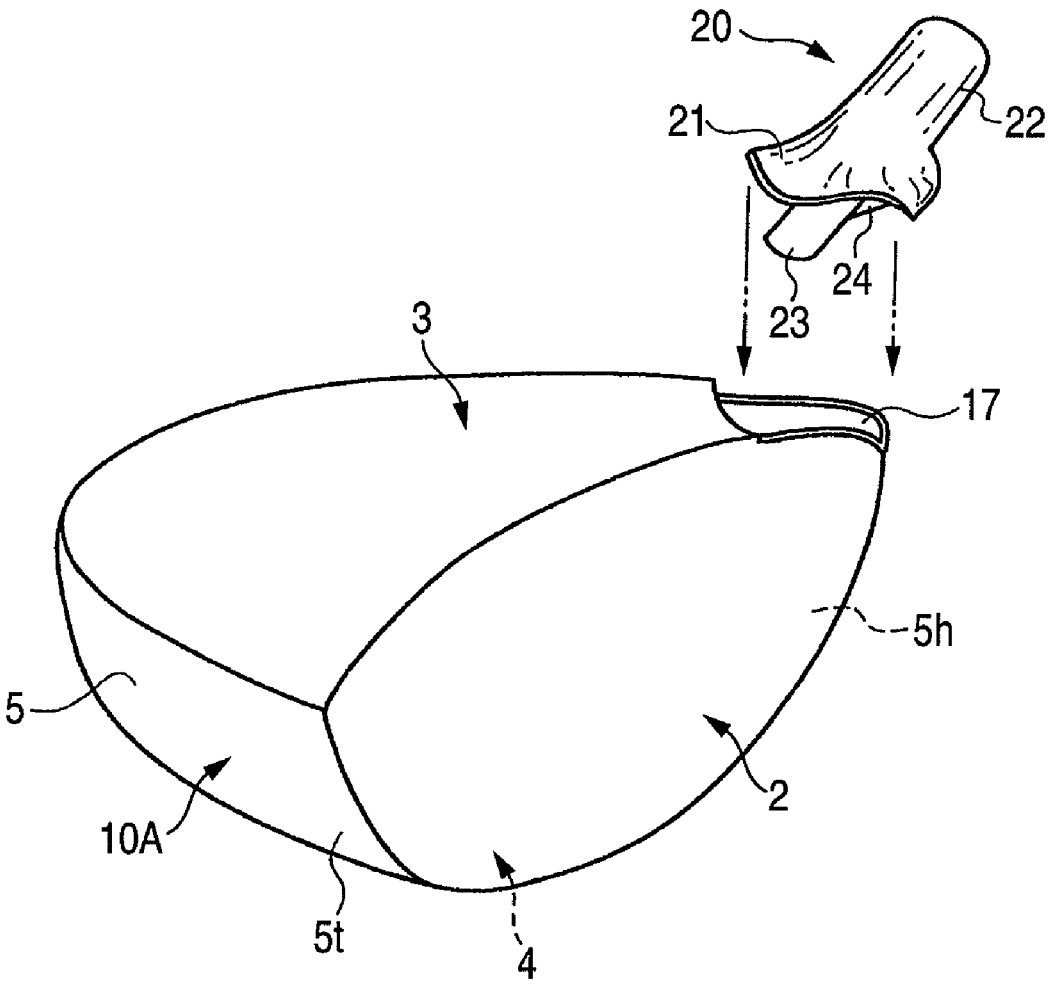
FIG. 2 is an exploded perspective view of the golf club head according to the first embodiment.
Figure 3:
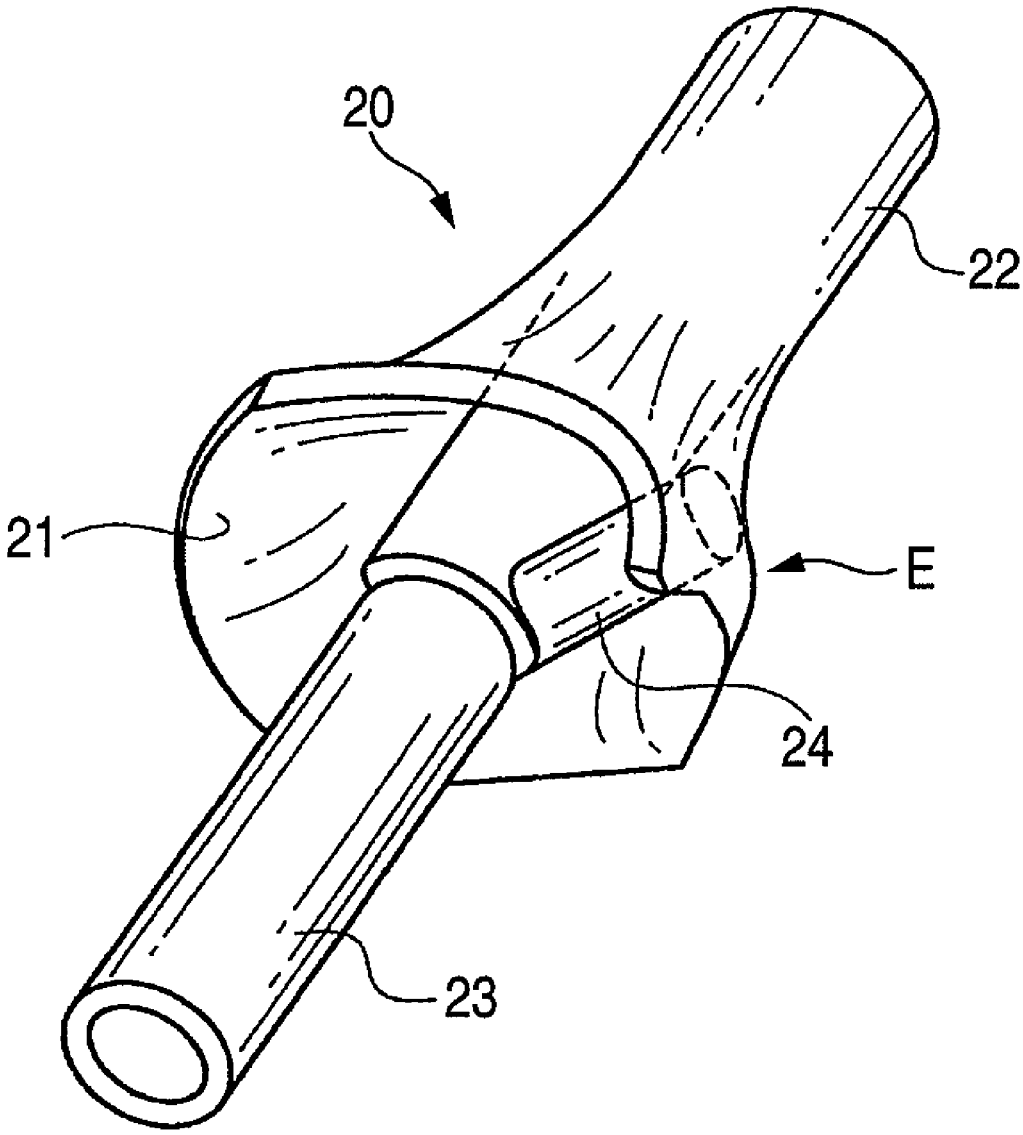
FIG. 3 is a perspective view of a hosel part according to the first embodiment.
Figure 4:
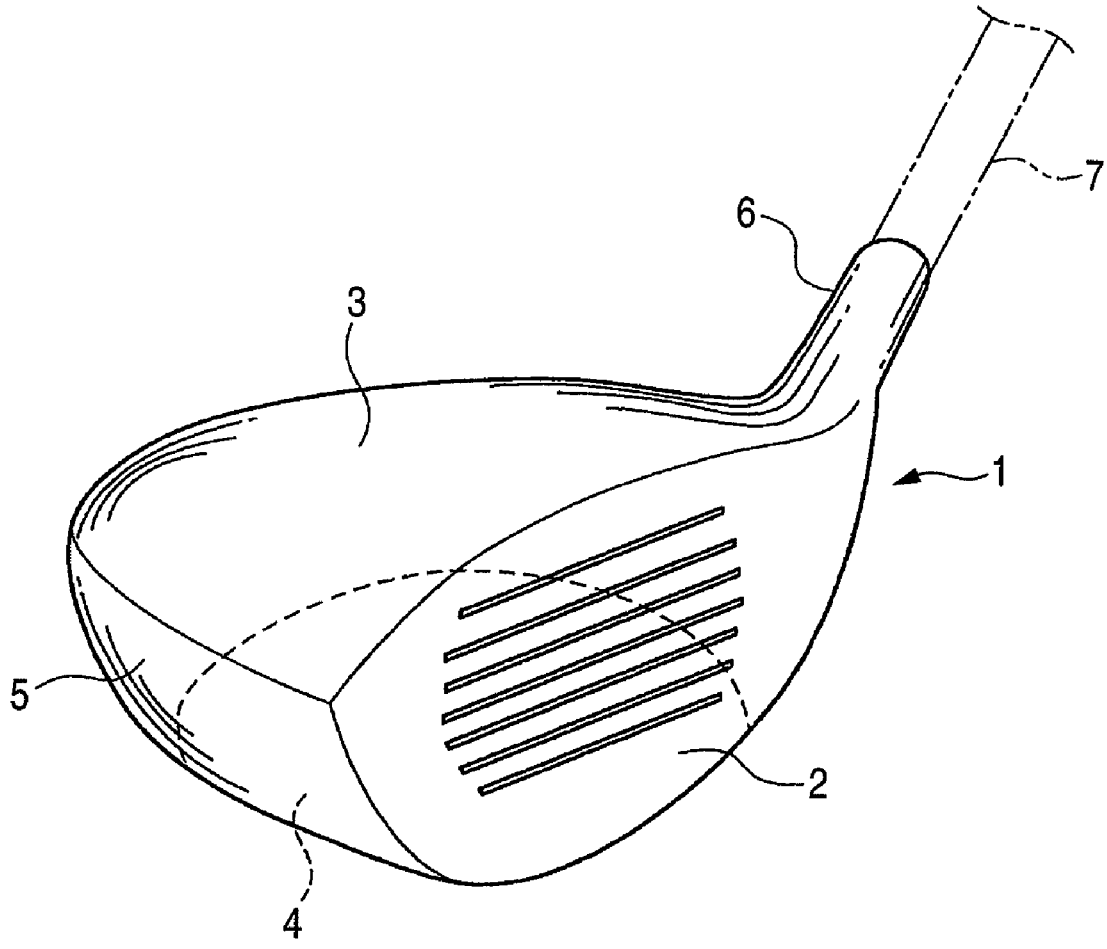
FIG. 4 is a perspective view of a conventional golf club head.

The preferred embodiments of the present invention will be described below with reference to the accompanying drawings. FIG. 1A is a perspective view of a golf club head according to a first embodiment of the invention, and FIG. 1B is a cross-sectional view of the golf club head as shown in FIG. 1A. FIG. 2 is an exploded perspective view of the golf club head. FIG. 3 is a perspective view of a hosel part.

The golf club head 1A includes a face portion 2, a crown portion 3, a sole portion 4, a side portion 5, and a hosel portion 6. Reference sign 5*t* denotes a toe side of the side portion 5, and 5*h* denotes a heel side of the side portion 5. The golf club head 1A is configured with metallic main body parts 10A having a hollow shell shape and a hosel part 20, which are integrated by arc welding, electron beam welding, laser welding or plasma welding.

A mounting portion 17 for the hosel part 20 is provided on an upper face of the main body parts 10A on the heel side. This mounting portion 17 has an aperture opened upwards.

The hosel part 20 includes a bell-shaped skirt portion 21, a upper column 22 extending upwards from the skirt portion 21, a lower column 23 extending downwards from the skirt portion 21, and a weight material 24 as a high specific gravity material disposed like a bridge between the lower column 23 and the skirt portion 21.

The skirt portion 21 has a convex portion E having an outwardly swollen shape in a (circumferential) part near a lower edge, the weight material 24 being bonded with the convex portion E.

The upper column 22 and the lower column 23 are like a coaxial barrel continuously and integrally provided, and welded on the skirt portion 21. A step portion 23*a* having a smaller diameter on a lower side is provided near a lower edge on an inner circumferential face of the lower column 23. A shaft is inserted into the hosel portion 6 until it abuts against the step portion 23*a*.

The weight material 24 is made of the high specific gravity metal material such as tungsten or tungsten alloy. In the embodiment, the weight material 24 is short and columnar, one end being fixed to the lower column 23 by welding, and the other end being fixed to the skirt portion 21 by welding.

The lower edge of the skirt portion 21 has a shape conforming to a hosel part mounting portion 17. The skirt portion 21 is engaged and welded with the hosel part mounting portion 17, and thus integrated with the main body parts 10A.

A material of the main body parts 10A is suitably titanium alloy, although the invention is not particularly limited. A portion of the hosel part 20 other than the weight material is suitably titanium alloy or pure titanium, but may be partially copper or copper alloy.

In the embodiment, the lower column 23 is so short as not to reach the sole portion, but is not limited to this configuration.

In the embodiment, the golf club head main body 10 is configured with the main body parts 10A and the skirt portion 21 of the hosel part 20. Also, the hosel portion 6 is configured with the upper column 22 and the lower column 23 of the hosel part 20.

In the golf club head 1A configured in this manner, the weight material 24 is disposed on the heel side 5*h*, so that center of gravity is closer to the heel side 5*h*, and moment of inertia is small. Therefore, even a beginner player uses this golf club head, it is easy to turn the head at a time of swing, and less likely to slice.

Particularly, in the embodiment, since the weight material 24 is displaced to the heel side by forming the convex portion E, the above effect is remarkable.

In the embodiment, the weight material 24 is welded to both the lower column 23 and the skirt portion 21, so that mounting rigidity is high. Therefore, even an impact is applied at the time of shot, the weight material 24 is not vibrated, and the feeling of hitting is excellent.

In the embodiment, the weight material 24 does not protrude from the head main body 10, and the convex portion E is configured to be a convex curved surface swollen smoothly outwards, as illustrated. Hence, the golf club head is smoothly put into or taken out of a caddie bag. Also, it is smoothly swung when used on a rough.

Figure 5:
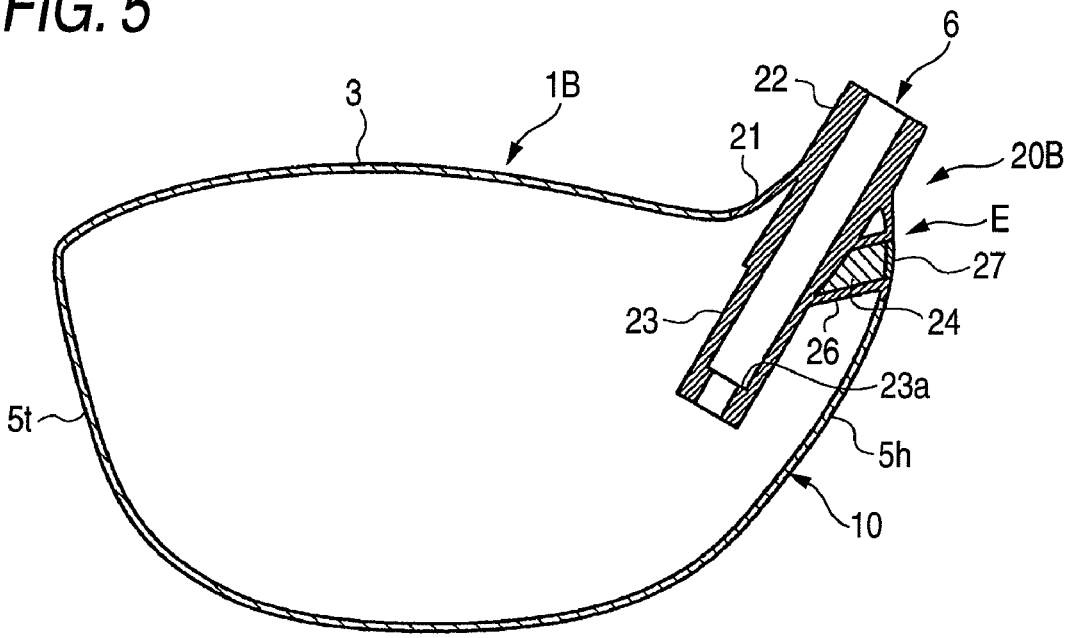
FIG. 5 is a cross-sectional view of a golf club head according to a second embodiment of the invention.
Figure 6:
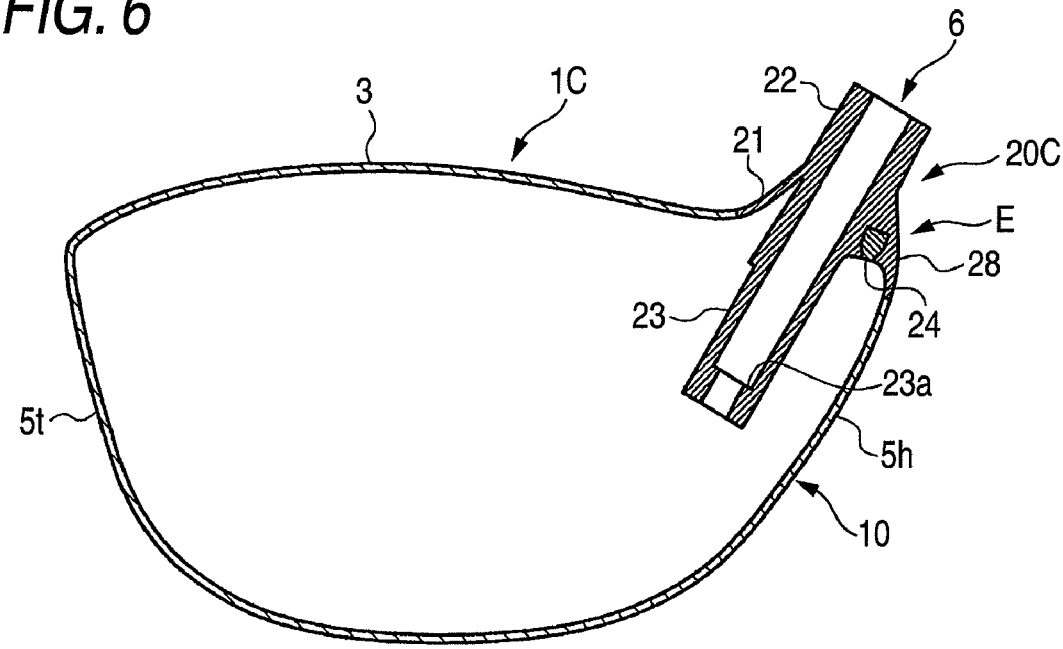
FIG. 6 is a cross-sectional view of a golf club head according to a third embodiment of the invention.

Referring to FIGS. 5 and 6, second and third embodiments will be described below.

As shown in FIG. 5, a golf club head 1B according to the second embodiment of the invention has a barrel portion 26 protruding like a branch from the lower column 23 of a hosel part 20B to the heel side, and the weight material 24 inserted into the barrel portion 26. A top end of the barrel portion 26 on the heel side leads to the skirt portion 21. A lid 27 is disposed to close the weight material 24, and welded to the skirt portion 21.

The lid 27 is preferably made of pure titanium or titanium alloy, but is not limited thereto.

Though the lid 27 is employed in FIG. 5, the weight material 24 may be secured by caulking or press fitting, an end face of the weight material 24 being exposed from an outer face of the golf club head 1B. In the case, it is preferred that the end face of the weight material 24 is finished to smoothly continue to the surrounding outer face of the head main body.

As shown in FIG. 6, a golf club head 1C according to the third embodiment of the invention has an overhang portion 28 in which the lower column 23 and the skirt portion 21 on the heel side are continuously integrated, with the weight material 24 held in the overhang portion 28. In the embodiment, a counterbore is provided on a lower face of the overhang portion 28, and the weight material 24 is press fit or caulked into the counterbore. The counterbore is provided on the lower face of the overhang portion 28 in FIG. 6, but may be provided on an outer face of the overhang portion on the heel side.

The other configuration of the golf club head as shown in FIGS. 5 and 6 is the same as in FIGS. 1 to 3. In these figures, the same numerals or signs designate the same or the same parts.

Figure 7A:
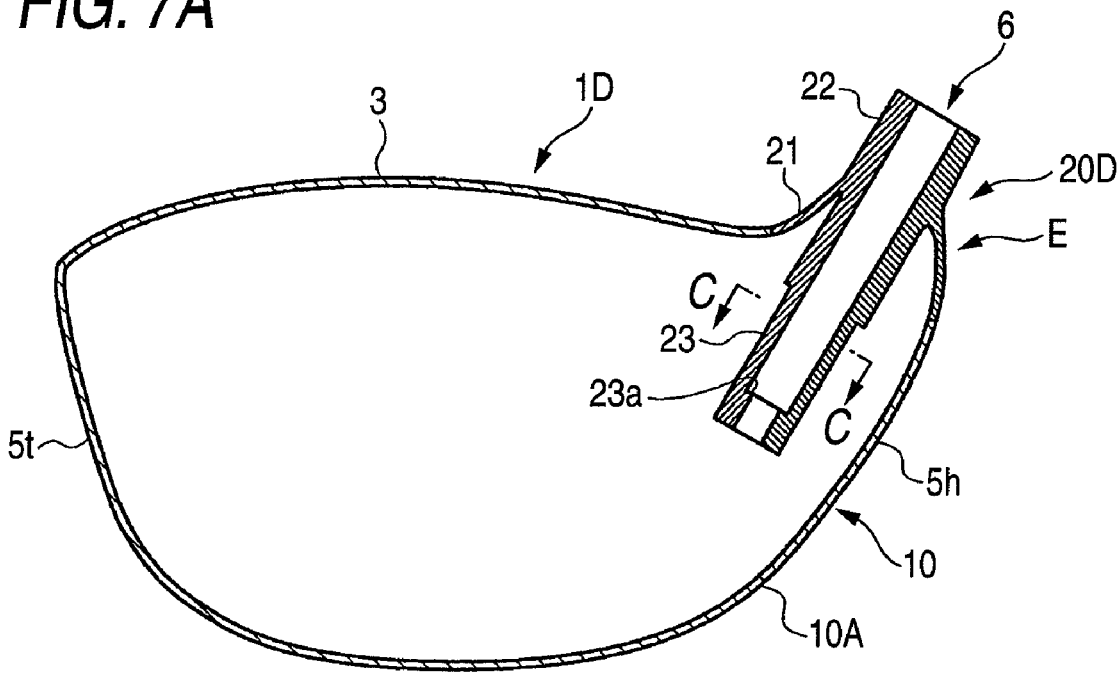
FIGS. 7A-7C are explanatory views of a golf club head according to a fourth embodiment of the invention.
Figure 7B:
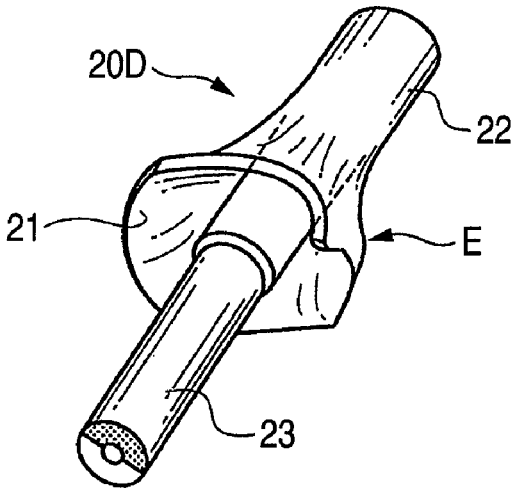
Figure 7C:
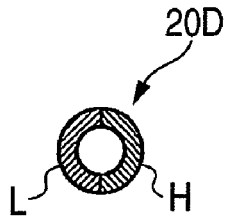

FIG. 7A is a front cross-sectional view of a golf club head 1D according to a fourth embodiment of the invention, FIG. 7B is a perspective view of a hosel part, and FIG. 7C is a cross-sectional view taken along the line C-C in FIG. 7A.

A hosel part 20D as employed in the embodiment includes the skirt portion 21, the upper column 22 and the lower column 23, and is made of a high specific gravity material H such as copper beryllium alloy on the heel side and a low specific gravity material L such as pure titanium or titanium alloy on the toe side. The hosel part 20D is not provided with the weight material, unlike the first to third embodiments, and the high specific gravity material H serves a function of the weight material. However, the weight material may be further added in the embodiment. The other configuration of FIG. 7 is the same as in the previous embodiments. In the figures, the same numerals or signs designate the same or the same parts.

The high specific gravity material H is preferably metal having specific gravity of 7.0 or greater, particularly 11 or greater. The high specific gravity material H may be made of nickel alloy, tungsten alloy, or stainless steel, other than copper alloys such as copper beryllium alloy and brass.

In FIG. 7, the hosel part 20D is divided into two portions on the toe side and the heel side, in which the heel portion is made of a high specific gravity material as a whole. However, the heel portion may be made of a high specific gravity material only in a part. For example, the lower column 23 may be only made of a high specific gravity material, or the hosel part 20D on the most heel side may be made of a high specific gravity material.

Figure 8:
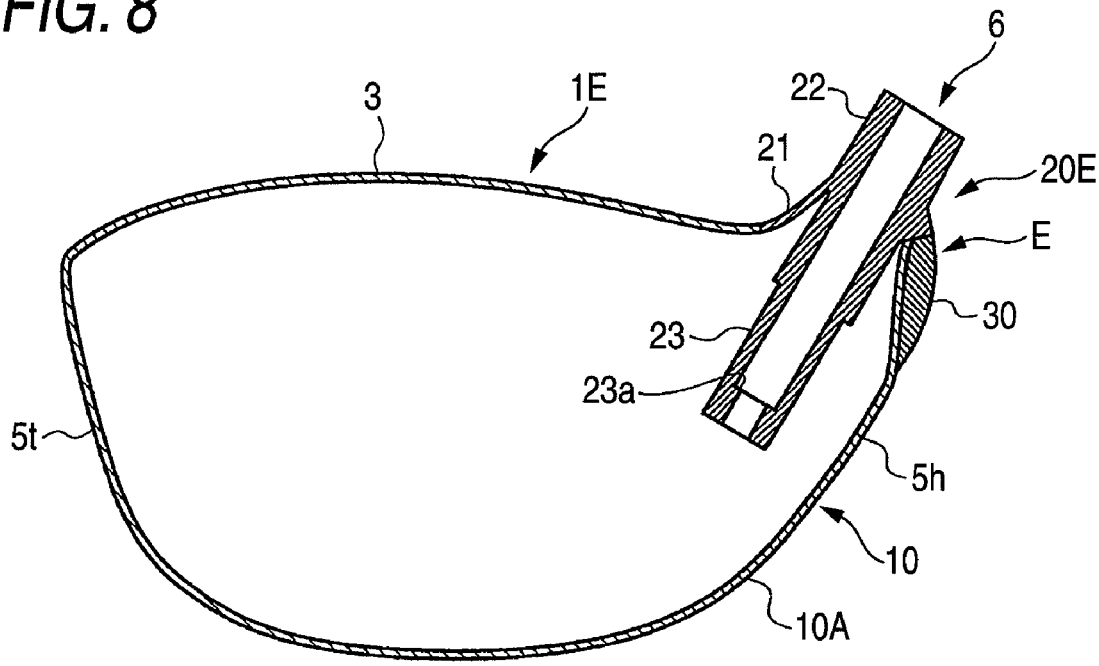
FIG. 8 is an explanatory view of a golf club head according to a fifth embodiment of the invention.

FIG. 8 is a front cross-sectional view of a golf club head 1E according to a fifth embodiment of the invention.

This golf club head 1E has a weight material 30 made of a high specific gravity metal material that is fixed by welding, caulking or screwing on an upper portion of the main body parts 10A made of low specific gravity metal material such as titanium or titanium alloy on the heel side 5*h*. An outer surface of the weight material 30 smoothly continues to the surrounding outer surface of the head main body.

The weight material 30 is preferably made of tungsten, tungsten alloy, copper alloy such as copper beryllium alloy or brass, nickel alloy (e.g., Ni-Bo alloy), or stainless steel.

In the embodiment, the weight material 30 is disposed on the outer surface of the main body parts 10A, but may be disposed on its inner surface. Reference sign 20E denotes the hosel part. In FIG. 8, the other numerals or signs designate the same or the same parts as in the previous embodiments.

Figure 9:
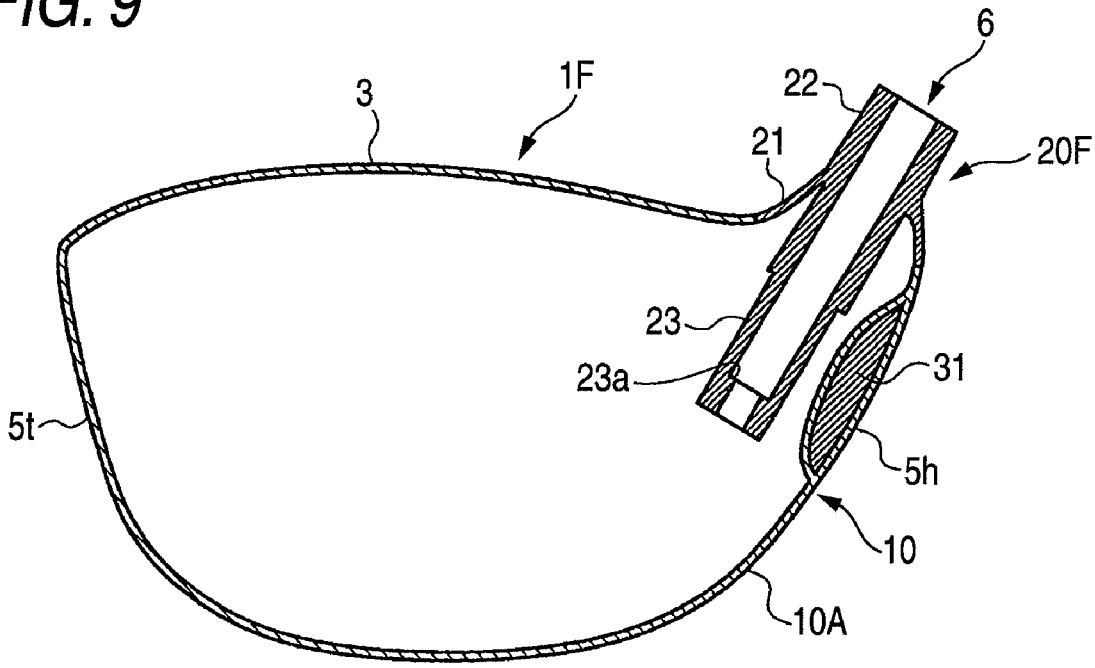
FIG. 9 is an explanatory view of a golf club head according to a sixth embodiment of the invention.

FIG. 9 is a front cross-sectional view of a golf club head 1F according to a sixth embodiment of the invention.

This golf club head 1F has a weight material 31 made of a high specific gravity material cast into a wall portion of the main body parts 10A on the heel side 5*h*. That is, the main body parts 10A are cast product. In casting, the weight material 31 is cast. The weight material 31 may be the same as the weight material 30, but because of no need of welding, may be a metal material that is difficult to weld. Practically, tungsten or tungsten alloy having high specific gravity is suitable. Reference sign 20F denotes the hosel part. In FIG. 9, other reference numerals or signs designate the same or the same parts as in the previous embodiments.

Figure 10A:
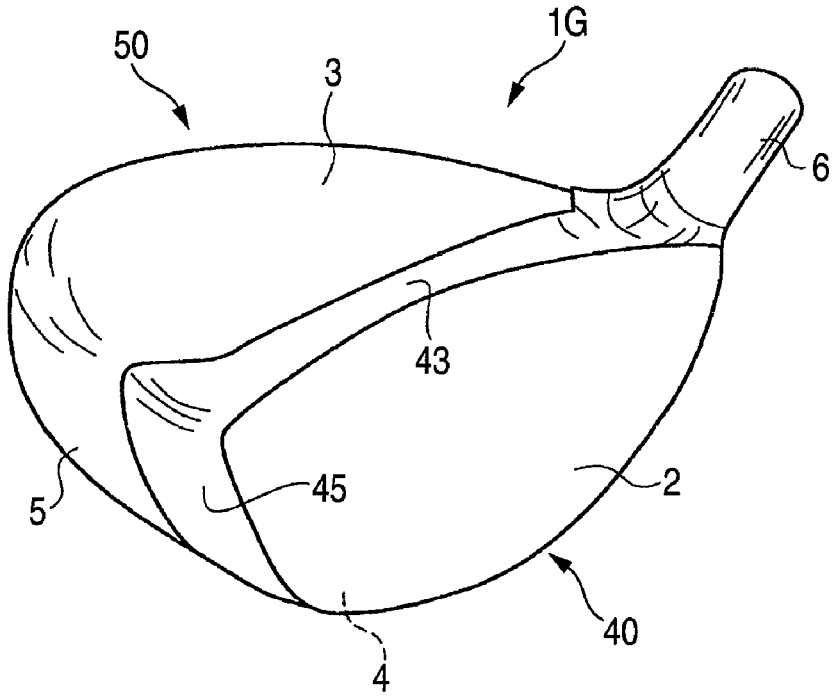
FIGS. 10A-10B are explanatory views of a golf club head according to a seventh embodiment of the invention.
Figure 10B:
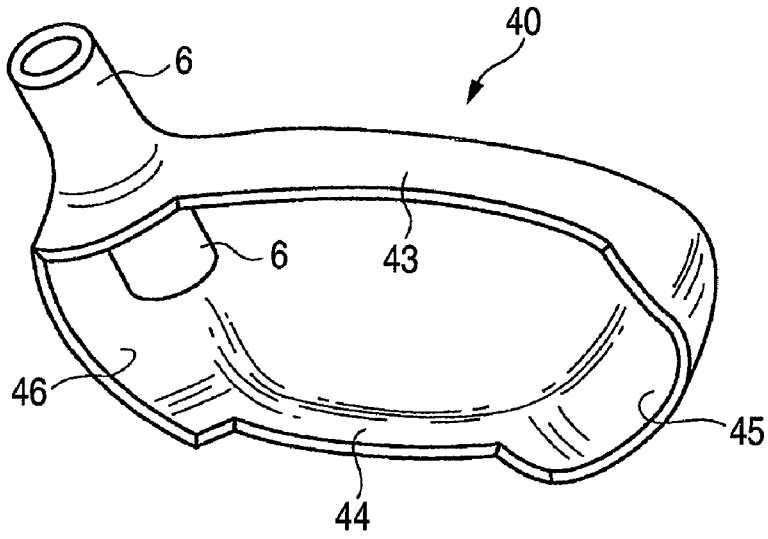
Figure 11A:
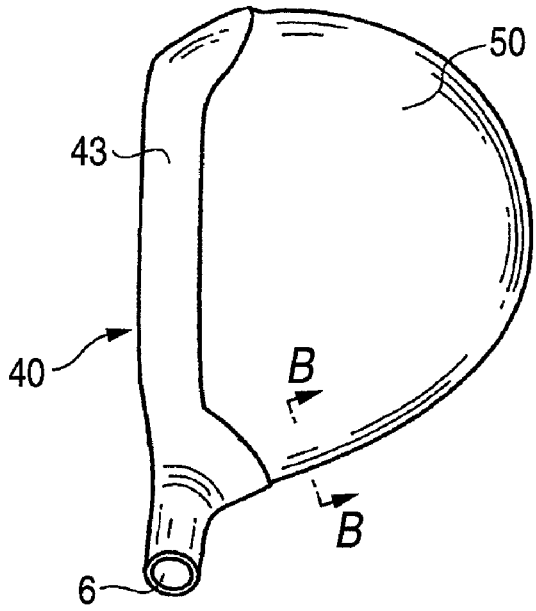
FIGS. 11A-11B are explanatory views of the golf club head shown in FIG. 10.
Figure 11B:
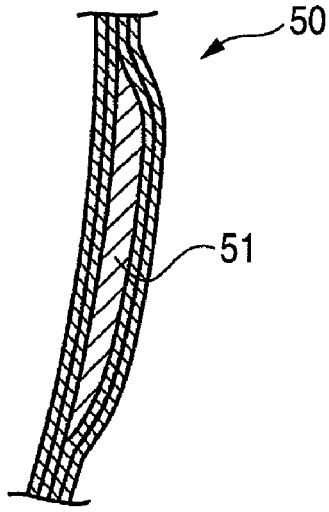

FIG. 10A is a perspective view of a golf club head 1G according to a seventh embodiment of the invention, and FIG. 10B is a perspective view of a front body of the golf club head as seen from a rear side. FIG. 11A is a plan view of the golf club head, and FIG. 11B is a cross-sectional view taken along the line B-B in FIG. 11A.

This golf club head 1G is a wood type golf club head having a hollow shell structure including the face portion 2, the crown portion 3, the sole portion 4, the side portion 5 and the hosel portion 6.

The golf club head 1G has a front body 40 made of titanium metal material (titanium alloy or pure titanium) and a fiber reinforced resin body (hereinafter referred to as an FRP body) 50. Though not being illustrated, a metallic sole plate is disposed on the sole. A weight of the front body is preferably from 20 to 70% of a weight of the golf club head, or more preferably from 30 to 60%.

The front body 40 includes the face portion 2, a metallic sole portion 44, a metallic side portion (toe) 45, a metallic crown portion 43, a metallic side portion (heel) 46, and the hosel portion 6, as shown in FIG. 10B.

The metallic sole portion 44 configures a front edge part of the sole portion 4. The metallic side portions 45 and 46 configure a front edge part of the side portion 5. The metallic crown portion 43 configures a front edge part of the crown portion 3. The metallic crown portion 43 continues into the metallic side portion (toe) 45 and the metallic side portion (heel) 46. The metallic side portion (toe) 45 and the metallic side portion (heel) 46 continue into the metallic sole portion 44. The metallic crown portion 43, the metallic side portions 45 and 46, and the metallic sole portion 44 continue into the face portion 2.

This front body 40 is preferably integrally molded especially by forging or casting. A weight material layer 51 made of a Nylon sheet or fiber reinforced plastic layer, or a metal piece, containing powder of a high specific gravity material is disposed inside a wall face on the heel side of the FRP body 50. In the case of Nylon sheet or fiber reinforced plastic layer containing the high specific gravity material powder, it may be disposed on an outermost or innermost face of the wall face on the heel side. In the case of metal piece, it is preferably disposed as an intermediate layer to prevent dropping as illustrated.

In the embodiments of FIGS. 10 and 11, the high specific gravity material may be suitably tungsten, tungsten alloy, stainless, lead, or copper alloy.

A manufacturing method for the golf club head will be described below.

To manufacture the golf club head 1G, the metallic front body 10, a sole plate, and a plurality of prepreg sheets are employed.

The prepreg sheets may be carbon fiber cloth or carbon fiber drawn in one direction impregnated with thermosetting plastic.

In molding the golf club head 1G, first of all, the sole plate is mounted in a mold having a cavity face of the sole or side shape in the golf club head 1G, and the plurality of prepreg sheets are superposed thereon. Then, the prepreg sheets are heated for a short time, formed into a shape of the FRP body 20 on the sole side, and integrated with the sole plate.

Apart from this, the prepreg sheets are mounted in a mold having a cavity face of a shape in which the crown portion and the side portion are linked. The prepreg sheets are heated for a short time to be half hardened, and formed into a shape of the crown portion and the side portion of the FRP body 50.

Thereafter, these shaped bodies and the metallic front body 40 are mounted in the mold (not shown) for the golf club head 1G.

Then, the mold is heated, gas pressure such as air is introduced through an opening (not shown) provided in the sole plate into the mold. The shaped body configured with half hardened prepreg sheets is pressed against an inner face of the mold to make the prepreg sheets fully hardened and fully connected with the front body 40.

Thereafter, the mold is released, and a finish treatment such as coating is performed with a bell body attached by screw in the opening of the sole plate, if required, thereby completing the product golf club head 1G.

Figure 12:
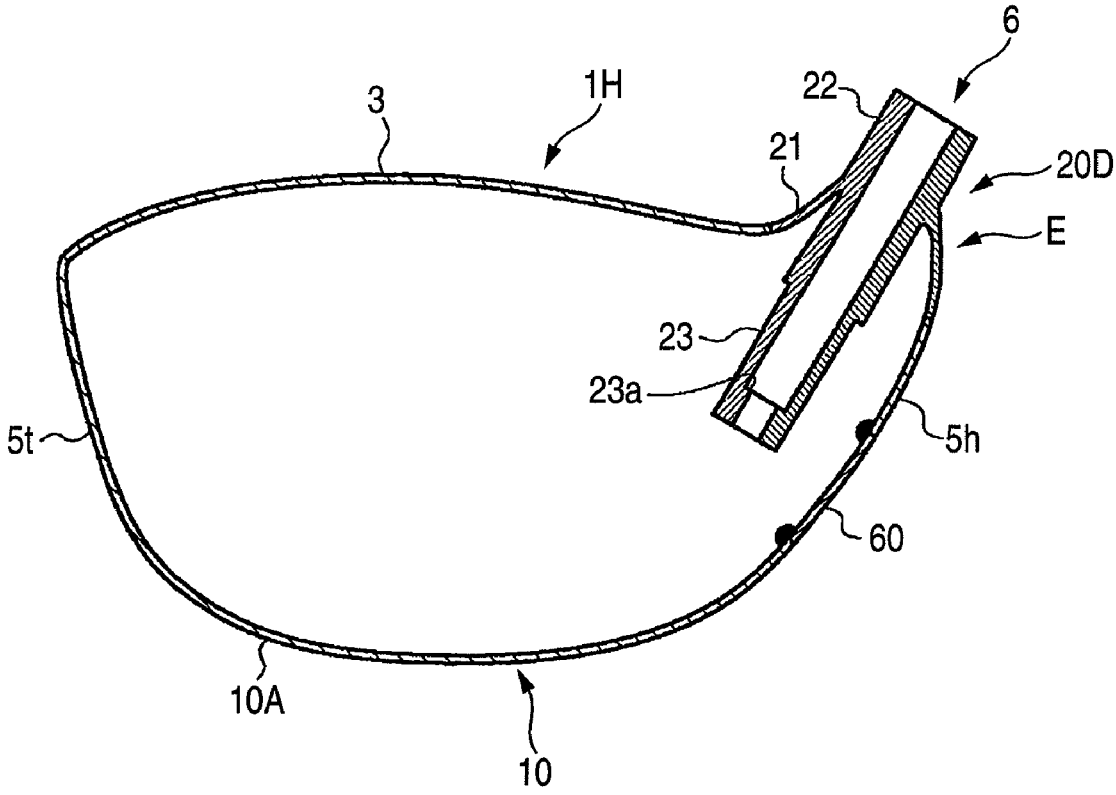
FIG. 12 is an explanatory view of a golf club head according to an eighth embodiment of the invention.

The golf club head 1H of FIG. 12 is provided with an opening on the heel side 5*h*, and has a weight material 60 configured with a plate made of a high specific gravity material (e.g., tungsten or copper alloy), which is fixed by welding with a lid put on the opening. A concave portion may be provided, instead of the opening, in which a high specific gravity plate is fitted, and fixed by welding.

The golf club heads 1B to 1H according to the embodiments of FIGS. 5 to 10 have the same excellent effects as the golf club head 1A. The golf club head 1C of FIG. 6 has very high rigidity of the overhang portion 28 in the hosel part 20C.

In the above embodiments, the hosel portion is provided to penetrate through an upper face of the golf club head, but may be provided to penetrate through an upper portion of the side face.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A golf club head comprising:

a hollow main body;

a hosel portion that penetrates through at least one of an upper face of the main body on a heel side and an upper side of a side face of the main body on the heel side; and a weight member that is provided on the hosel portion at a heel side thereof, wherein the specific gravity of the weight member is greater than a specific gravity of the hollow main body, wherein the hosel portion includes a skirt portion and a column extending downwards from the skirt portion, wherein the skirt portion includes a convex portion protruding outwards, and the weight member is fixed to an inner surface of the convex portion.

2. A golf club head comprising:

a hollow main body;

a hosel portion that penetrates through at least one of an upper face of the main body on a heel side and an upper side of a side face of the main body on the heel side; and a weight member that is provided on the hosel portion at a heel side thereof, wherein the specific gravity of the weight member is greater than a specific gravity of the hollow main body, wherein the hosel portion includes a skirt portion and a column extending downwards from the skirt portion, and the weight member is disposed within the skirt portion, wherein the hosel portion includes a column extending downwards, wherein the weight member comprises a barrel portion filled with a weight material, the barrel portion extending from the column toward a heel side of the golf club head.

* * * * *